US007090553B1

(12) United States Patent
Seiford, Sr.

(10) Patent No.: US 7,090,553 B1
(45) Date of Patent: Aug. 15, 2006

(54) PADDLE WHEEL PROPULSION SYSTEM AND IMPROVED PADDLE USED THEREWITH

(76) Inventor: Donald S. Seiford, Sr., 14312 Vista Del Lago Blvd., Winter Garden, FL (US) 34787

( * ) Notice: Subject to any disclaimer, the term of this patent is extended or adjusted under 35 U.S.C. 154(b) by 0 days.

(21) Appl. No.: 11/062,801

(22) Filed: Feb. 23, 2005

(51) Int. Cl.
*B63H 1/04* (2006.01)

(52) U.S. Cl. ..... 440/90
(58) Field of Classification Search ..... 440/90, 440/15; 416/240, 243, 197 R, 197 B, 197 A; D12/306
See application file for complete search history.

(56) References Cited

U.S. PATENT DOCUMENTS

| | | | | | |
|---|---|---|---|---|---|
| 624,349 | A | * | 5/1899 | Lighthall | 416/197 R |
| 729,397 | A | * | 5/1903 | Nowak | 416/109 |
| 4,051,622 | A | * | 10/1977 | Sharp | 446/48 |
| 4,177,014 | A | * | 12/1979 | Kephart, Jr. | 416/197 A |
| 5,213,528 | A | * | 5/1993 | Seiford, Sr. | 440/90 |

* cited by examiner

*Primary Examiner*—Stephen Avila
(74) *Attorney, Agent, or Firm*—Ronald E. Greigg

(57) ABSTRACT

A paddle wheel propulsion system includes a paddle wheel mounted for rotation about its horizontal axis for propelling a vessel, and for unlimited rotation about a vertical axis perpendicular to its horizontal axis for steering the vessel. The paddle wheel is also supported for limited vertical movement relative to the vessel. Reversible power drive is provided for independently controlling movement of the paddle wheel about its vertical and horizontal axes and for elevating and lowering the paddle wheel. Improved paddles are concave on both sides to provide maximum efficiency in both direction of rotation about the horizontal axis.

18 Claims, 6 Drawing Sheets

PADDLE WHEEL PROPULSION SYSTEM AND IMPROVED PADDLE USED THEREWITH

BACKGROUND OF THE INVENTION

1. Field of the Invention

This invention relates to an improved paddle wheel propulsion system for use in propelling and steering water vessels, and to an improved paddle used in such paddle wheels.

2. Description of the Prior Art

Paddle wheels of the general type with which this invention is concerned are well known and have long been used for propelling boats, barges, or even small ships (hereinafter, vessels). Such paddle wheels are also sometimes used for powering generators and other equipment. Examples of paddle wheels used for such purposes are disclosed, for example, in U.S. Pat. Nos. 2,672; 22,884; 258,023; 4,279,603; and 4,488,055, and in my prior U.S. Pat. No. 5,213,528.

While paddle wheels are well known, and can be an energy efficient means of propelling vessels, they are no longer widely used for various reasons. For example, the efficiency of a paddle wheel depends to some extent upon the depth of submergence into the water; however, the known paddle wheel systems generally have not been readily adjustable to compensate for draft changes of the vessel to thereby maintain the paddle wheel at its most efficient submergence depth.

Vessels propelled by the known paddle wheel systems also generally have not been easily maneuverable for steering, and rudders employed with such systems are less efficient, requiring greater size for effective steering. The known systems generally have required complex drive systems to permit driving the paddle wheels in reverse for slowing or backing the vessel. Further, the configuration of the paddles of the known systems generally have not been such as to produce the maximum thrust, particularly when driven in reverse, so that maximum efficiency was not always obtained.

As a result of the above and other drawbacks of known paddle wheel propulsion systems, their use has generally been limited to relatively light, wide-beamed vessels of the type used in relatively calm waters such as rivers and lakes and in which the draft does not vary greatly with load. Accordingly, it is a primary object of the present invention to provide a paddle wheel propulsion system which overcomes the shortcomings of the prior art as discussed above.

Another object is to provide such a system in which the paddle wheel can readily and easily be raised and lowered as necessary with changes in the boat's draft to maintain the paddle wheel at its most efficient position.

Another object is to provide such a system in which the paddle wheel is supported for unlimited pivotal movement about a vertical axis perpendicular to its axis of rotation for maneuvering and/or backing the boat.

Another object is to provide such a system in which the paddles are contoured to provide maximum thrust regardless of the direction of rotation of the paddle wheel.

SUMMARY OF THE INVENTION

In the attainment of the foregoing and other objects and advantages, an important feature of the invention resides in mounting a paddle wheel for rotation about its horizontal, longitudinal axis by a pair of bearing members supported one at each end of the wheel by a carrier assembly slidably moveable along a vertical channel as by hydraulic cylinder actuators. The vertical channels are carried by a rigid frame assembly including a horizontally disposed circular turntable or platform having a track extending around its outer periphery and having a generally rectangular opening in its center through which the paddle wheel is movable by the hydraulic cylinder actuators to adjust the position of the paddle wheel depending upon the draft of the boat.

The turntable is mounted for rotation about a vertical axis perpendicular to and concentric with the circular track by an annular support rail carried on and projecting from the stern of the vessel. A plurality of support rollers carried on the rail engage the circular track at spaced intervals therearound to provide vertical and lateral stability of the rigid frame and the paddle wheel carried thereon. Power means is provided for driving the turntable and paddle wheel for rotation in either direction around the annular rail, and reversible hydraulic motors mounted on each of the carrier assemblies drive the paddle wheel about is horizontal axis. A suitable swivel coupling in the hydraulic lines to these hydraulic motors enables the turntable and the paddle wheel supported thereon to be rotated through 360° in either direction. Rotation of the paddle wheel turntable enables steering and backing of the boat by use of the propulsion system alone.

The paddles are supported on the paddle wheel for rotation about their longitudinal axis in a manner similar to that described in U.S. Pat. No. 5,213,528, the disclosure of which is incorporated herein by reference. Both faces of the paddles are concave so as to provide maximum thrust upon rotation of the paddle wheel through the water in either direction. The longitudinal (top and bottom) edges of the paddles are rounded to minimize splash and reduce resistance upon entering the water, and are preferably reinforced by a round bar, a pipe, or a section of a pipe which defines the curvature of the rounded edges.

BRIEF DESCRIPTION OF THE DRAWINGS

Other features and advantages of the invention will become apparent from the description contained herein below, taken in conjunction with the drawings, in which.

DESCRIPTION OF THE PREFERRED EMBODIMENT

Figure 1:
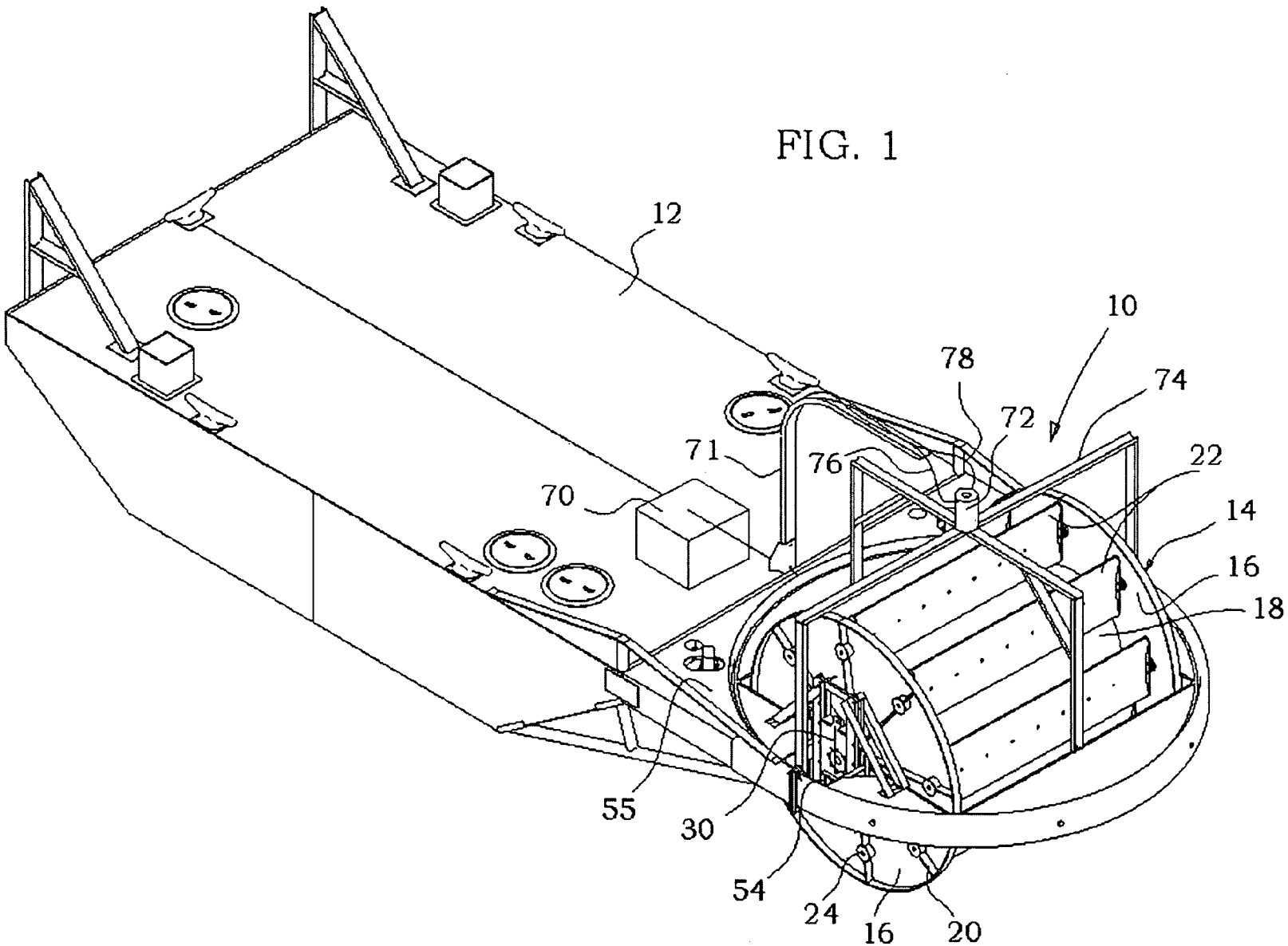
FIG. 1 is an isometric view of a vessel, for example, a barge pusher, equipped with a paddle wheel propulsion system of the invention.
Figure 2:
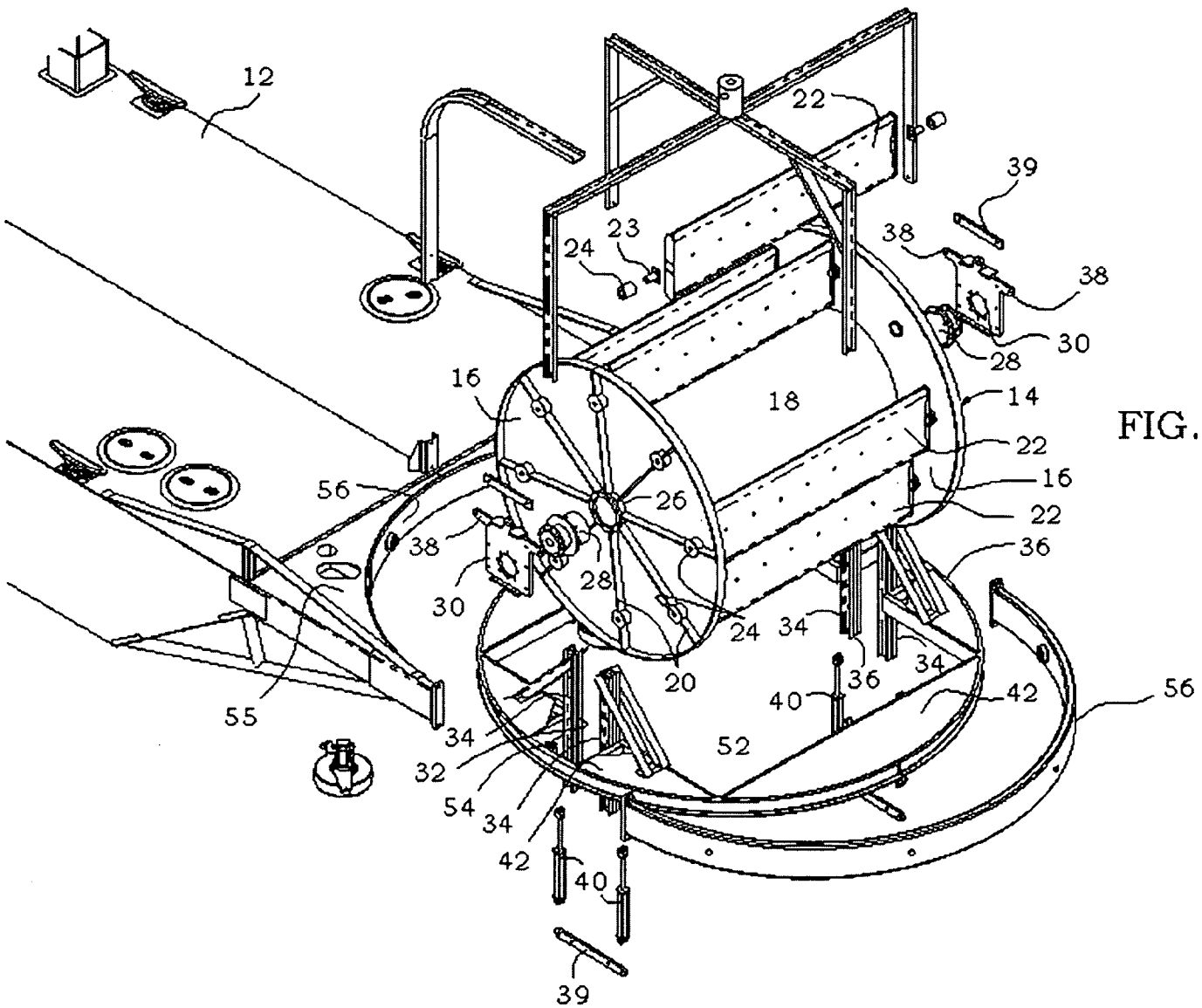
FIG. 2 is an enlarged, exploded view of a portion of the structure shown in FIG. 1.
Figure 3:
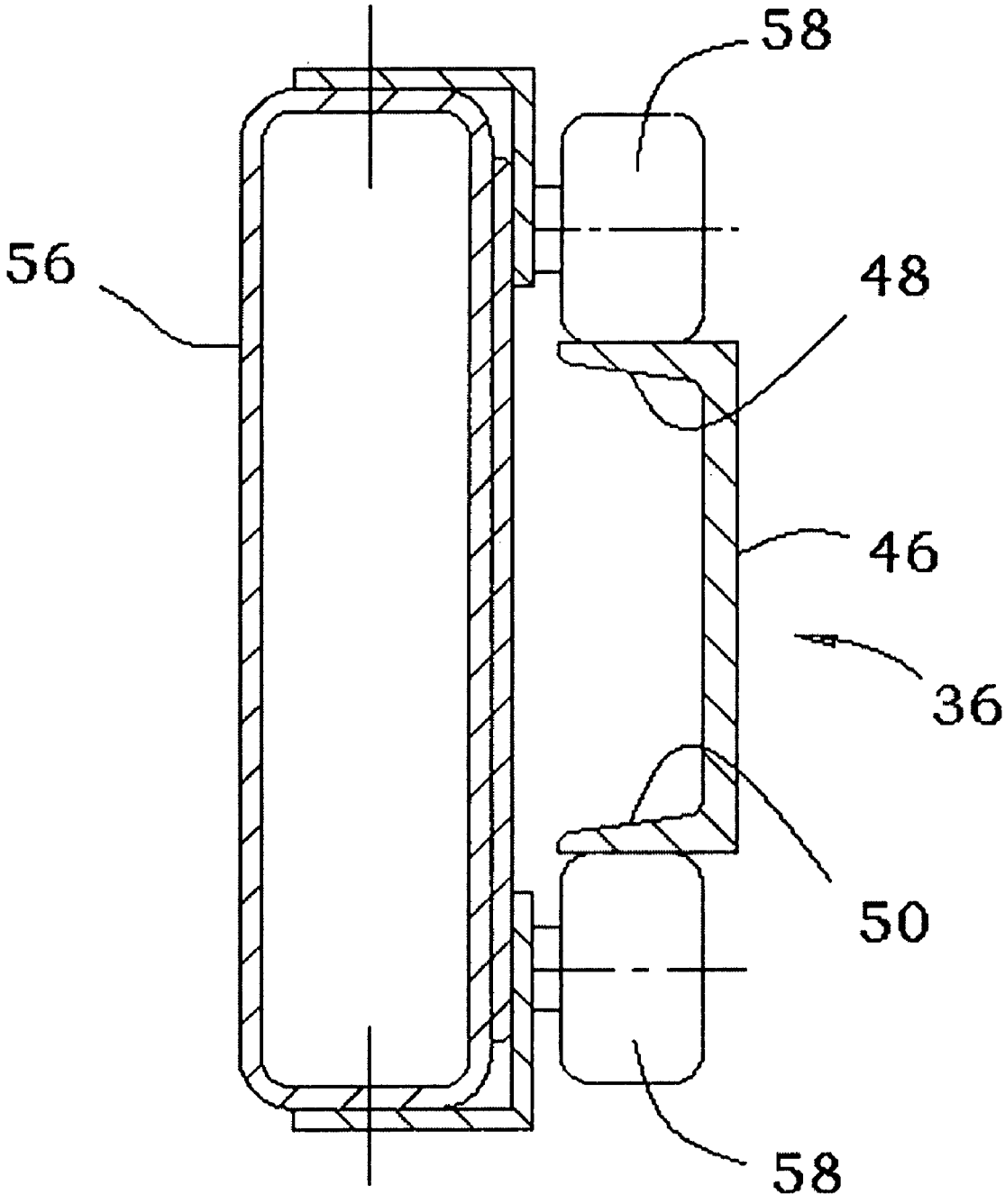
FIG. 3 is a fragmentary sectional view taken along lines 3—3 of FIG. 1 showing the vertical roller support for the paddle wheel platform.
Figure 4:
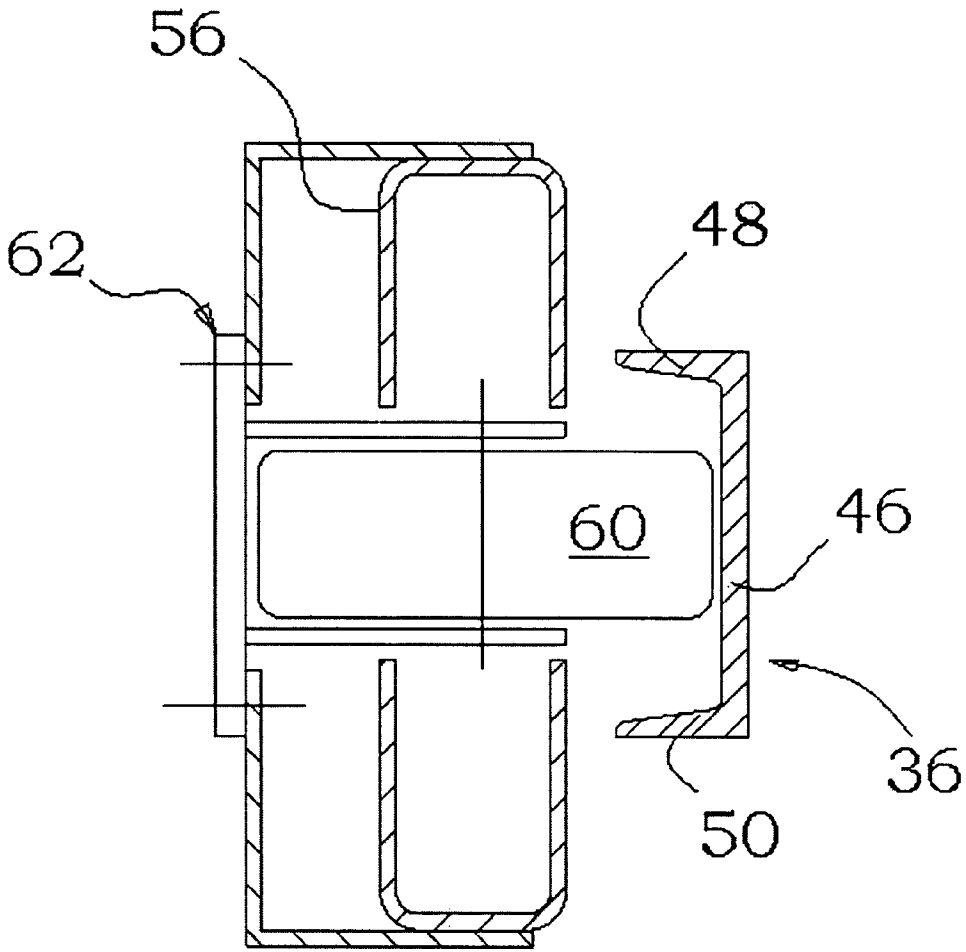
FIG. 4 is a view similar to FIG. 3 showing the horizontal stabilizing roller support for the platform.
Figure 5:
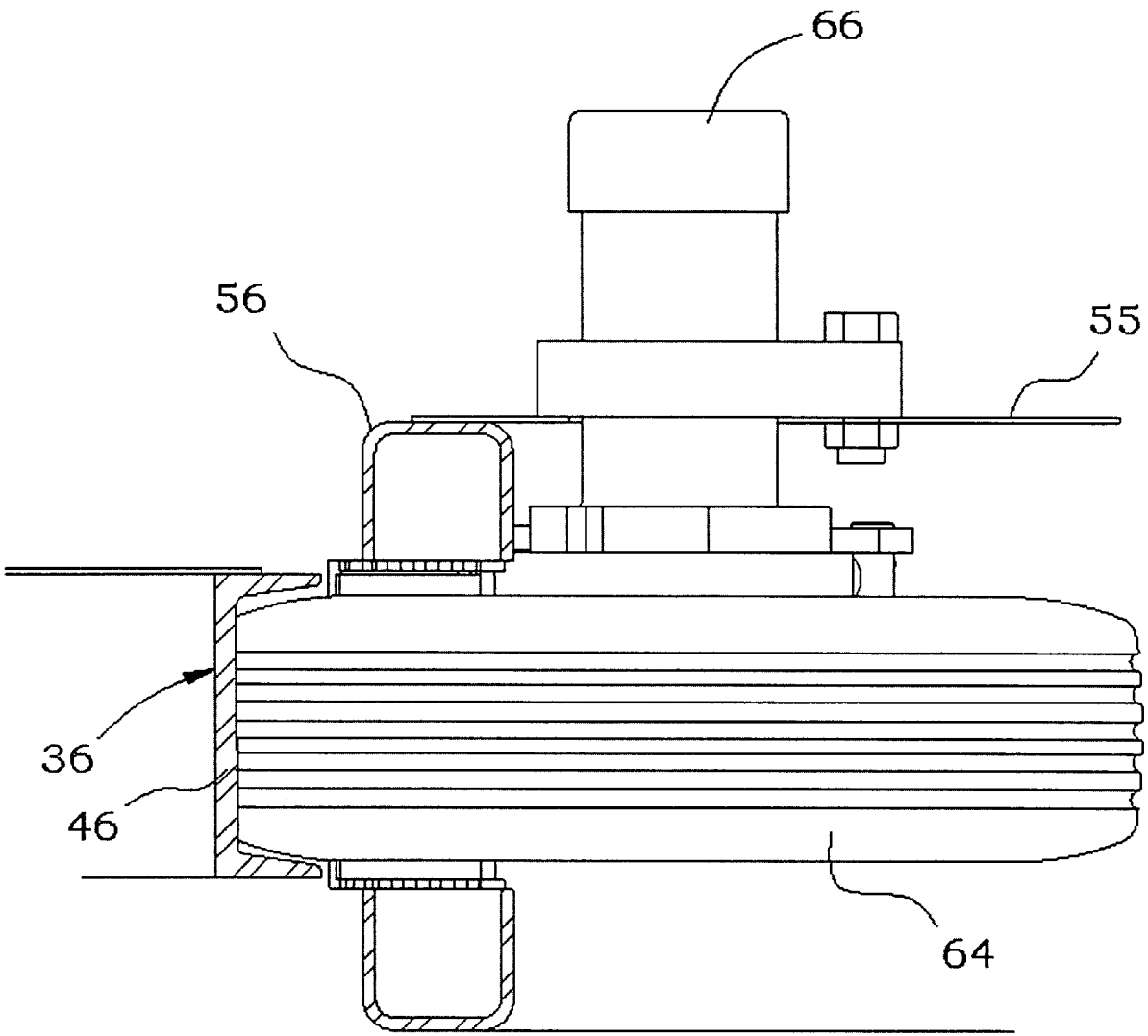
FIG. 5 is a fragmentary elevation view schematically showing the hydraulic drive for rotating the turntable.

Referring now to the drawings in detail, the paddle wheel propulsion system of the present invention, indicated generally in FIG. 1 by the reference number 10, is shown mounted on the stern of a barge pushing vessel 12. The system includes a paddle wheel 14 made up of a pair of circular, generally disc-shaped, spaced end flanges 16 rigidly joined, as by welding, one on each end of an elongated cylindrical hub or core 18, with the flanges 16 each being reinforced by a plurality of radially extending spoke-like ribs 20 rigidly welded to their outwardly directed faces. The number of ribs on each flange corresponds to the number of elongated paddles 22 on the wheel, and each paddle has a stub shaft 23 on its opposed ends rotatably mounted in a journal bearing 24 rigidly mounted on and extending through the end flanges 16 at each rib 20.

The paddle wheel 14 is supported for rotation about its longitudinal center axis by a hub 26 on each flange 16 joined, as by bolting, to a mounting flange on one end of a rotary hydraulic motor 28 which has its other end mounted, again by bolting, to a generally rectangular vertically sliding guide plate 30. The guide plates 30 each have opposed vertical side edge portions disposed one in each of a pair of opposed vertical guide channels or grooves 32 each defined by vertically extending structural members 34 of a circular platform or turntable 36. A pair of arms 38 are integrally formed on and extend outwardly one from each lateral edge portion of each plate 30, and a linear fluid actuator or ram 40 is connected between each arm 38 and the platform 36 for sliding the plate 30 vertically in the grooves 32 to raise or lower the paddle wheel relative to the boat to maintain the paddle wheel submerged to the desired depth and thereby compensate for changes in draft of the boat. Transversely extending bars 39 at the top and bottom of channels 32 provide positive stops limiting the vertical movement of the guide plates 30.

The platform 36 has a horizontal deck 42 surrounded by a rim-like supporting track 44 in the form of a rolled structural channel having a generally C-shaped cross section with its web 46 in the vertical plane and its top and bottom flanges 48, 50, respectively, directed outward. A large rectangular opening 52 is provided in the deck 42 to permit the paddle wheel assembly to be moved vertically therethrough by the rams 40. The structural members 34 defining the guide grooves 32 for the sliding plates 30 are rigidly mounted in recesses 54 on opposed sides of the opening 52.

The platform 36 and the paddle wheel structure mounted thereon are supported for rotation about the vertical axis of the circular platform by a rigid deck structure 55 projecting rearwardly from the stern of the vessel 12. The deck 55 includes an annular support rail 56 closely surrounding the track 44, and a plurality of vertical support rollers 58 are mounted for rotation about horizontal axis extending radially to the rail. The rollers are arranged in opposing pairs on the rail 56, with one roller of each pair engaging and supporting the top and bottom flanges 48, 50, respectively, of the track 44 to support the platform and paddle wheel for rotation within the annular rail 56. In the drawings, eight pair of rollers 58 are illustrated as being equally spaced around the rail 56.

In order to maintain the track 44 concentric within the annular rail 56, a plurality of horizontal guide rollers 60 are mounted, as by brackets 62, on the rail 56 at spaced intervals therearound for rotation about vertical axis, with the rollers 60 engaging the outwardly directed surface of web 46 between the flanges 48, 50. Six guide rollers 60 may be spaced, for example, at 45° intervals around the rail, leaving one space of 135° between adjacent rolls. In addition, two drive wheels on 64 mounted on deck 55 and projecting through rail 56 engage the flange 48 in the 135° space, with the drive wheels 64 being driven by suitable means such as reversible rotary hydraulic motors 66 to rotate the platform 36 and the paddle wheel mounted thereon in either direction about the vertical axis of the rail and track. Drive wheels 64 may be mounted on a support arm pivotally mounted on deck 55, and suitable biasing means such as a spring may be employed to resiliently bias the arm in a direction to urge the wheel surface into contact with the web 46.

Hydraulic fluid is supplied from the vessel 12, as by a pump indicated at 70, to the motors 28 through a double-pass swivel union 72 mounted on the vertical rotation axis of the platform 36 above the paddle wheel by a support frame 74 mounted on the platform for rotation within. Double pass swivel unions suitable for this use are readily available commercially, and as such form no part of the invention. Fluid under pressure is supplied from pump 70 to union 72 through a flexible inlet conduit, or hose 76 supported on a rigid arm 77 extending from the boat to a position adjacent the union. A second hose 78 returns hydraulic fluid to the pump. From the union 72, two pressure hoses, not shown, extend along and are supported by the frame 74, and are connected one to the inlet of each of the hydraulic motors 28, and two return hoses, also not shown, return the hydraulic fluid from the outlet ports of motors 28 to the union 72 for return to pump 70 through hose 78. The swivel union permits unlimited rotation, in either direction, of the platform 36, and the paddle wheel supported thereon. The outer body of the union and the hoses leading to and from the motors 28 rotate with the platform while the hydraulic hose connections between the union and pump, supported by arm 77, prevent rotation of the swivel housing of the union. The length of the flexible hoses 78 and 80 permit the paddle wheel to be moved vertically along the vertical guide channels 32 by actuation of the rams 40. At the same time, the platform 36 and the paddle wheel may be rotated around the annular rail 56 by supplying hydraulic fluid, under pressure, to the reversible hydraulic motors 66 to drive the wheels 64 in the desired direction. The supply of hydraulic fluid from the pump unit 70 to the motors 66 and to the rams 40, as well as the motors 28, is regulated by suitable controls, not shown, on the vessel 12, and the controls may be actuated independently or simultaneously to control the speed and direction of rotation of the paddle wheel, the elevation of the paddle wheel relative to the vessel, and the steering angle of the paddle wheel, i.e., the angular position of the rotational axis of the paddle wheel relative to the longitudinal, or fore-and-aft axis of the vessel.

Figure 7:
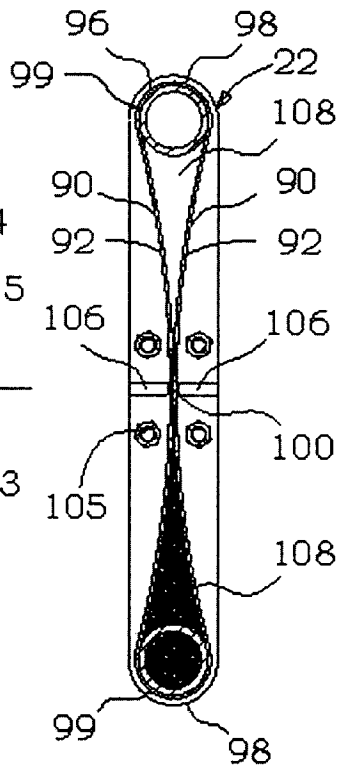
FIG. 7 is a sectional view taken along lines 7—7 of FIG. 6.
Figure 6:
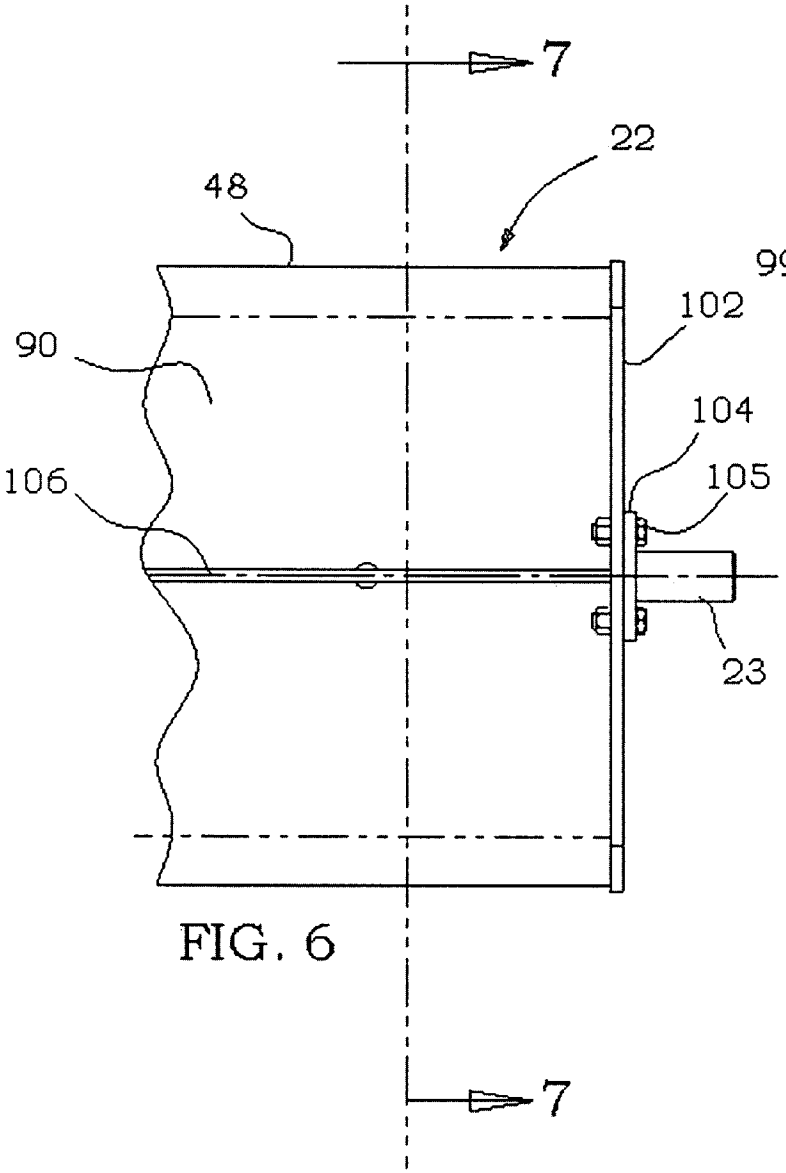
FIG. 6 is a fragmentary elevation view of an improved paddle used in the paddle wheel.

Referring now to FIGS. 6 and 7, it is seen that the paddles 22 are elongated, generally board-like structures having opposed side faces 90 each defined by an elongated metal plates, or strips 92 curved to present a generally arcuate, concave face surface 90 throughout the major portion of the width of the paddle. The two metal plates 92 defining each paddle have their lateral side edges 96 reversely bent and joined to define a smooth, convex or arcuate side edge portion 98 of the paddle. Alternatively, the side edges may be defined by a section of a metal pipe or a rolled metal bar 99 which is positioned within the edge portion of the paddle 22 or welded to the lateral edges 96 of the plates 92. The plates 92 preferably contact each other and are rigidly joined together, as be welding, along a line 100 substantially midway between the side edges 96 to rigidify and strengthen the structure. The paddles may also be reinforced by a flat metal bar 106 welded to each concave surface and extending at least substantially the full length of the paddles between bars, or end plate, 102, generally along line 100.

The ends of the metal plates 92 are welded to a flat metal bar 102 having a width corresponding to the maximum thickness of the paddle at its side edges, with the bar 102 having its end portions rounded to correspond to the arcuate side edges 98. The stub shafts 23 have one end rigidly welded to a mounting plate 104 which, in turn, joined as by bolts 105 to the end bars 102 as seen in FIG. 6.

As seen in FIG. 7, a generally tear-drop shaped void 108 is formed between the opposed metal plates 92, and one of these voids is filled with a heavy solid material such as concrete to maintain the paddle in the vertical position shown in FIG. 1 and as described in U.S. Pat. No. 5,213,528, supra. Thus, the external configuration of the paddle is symmetrical about both its vertical longitudinal center plane and about its horizontal longitudinal center plane, and the added weight in the lower void 108 will maintain the paddle in the vertical position shown in FIG. 1. Since the paddles 22 are concave on both faces, maximum thrust, or efficiency, will be realized regardless of the direction of rotation of the paddle wheel.

In operation of a vessel having the paddle wheel propulsion system described above, the hydraulic rams 40 are actuated to position the paddle wheel at the desired depth in the water, and the motors 28 are driven to rotate the paddle wheel about its axis to propel the boat through the water in the desired direction. For straight forward or backing of the vessel, the axis of rotation of the paddle wheel will be substantially perpendicular to the longitudinal vertical center plane of the vessel, and the propelling force developed will depend upon the hydraulic power delivered to the drive motors 28. To steer the vessel, motors 66 are driven to rotate the platform about the center of the annular support rail 56 so that the thrust of the paddle wheel is no longer parallel to the center plane of the vessel. For example, in FIG. 1, with the vessel 12 being driven in the forward direction, if the platform 36 is rotated clockwise, a component of the paddle wheel thrust will tend to move the stern of the vessel to the right, steering the vessel to the left. For a given rate of rotation of the paddle wheel, the magnitude of the lateral thrust component, and consequently the turning or steering force applied to the vessel, will depend upon the angle of rotation of the platform 36, with this component increasing up to a platform rotation angle of 90° where the entire thrust will be directed transverse to the boat's longitudinal center plane. Further rotation of the platform, with the paddle wheel still being driven in the same direction by motors 28, will result in a decreasing lateral thrust and increasing reverse thrust, up to a platform rotation of 180° where the entire paddle wheel thrust will be in reverse. Still further rotation of the platform up to 270° from the initial straight forward drive position, will produce an increasing lateral thrust component in the opposite direction and a decreasing reverse thrust component until at 270° platform rotation, all thrust will be to the right in FIG. 1. Finally, from 270° to 360°, lateral thrust will decrease and forward thrust will increase until at 360°, all thrust will again be in the straight forward direction. By using reversible power means, preferably reversible hydraulic motors and rams, for powering all of the driven components, the vertical position of the paddle wheel and its direction of rotation about its horizontal axis as well as its angular position about its vertical axis can be controlled from the pilot house or control station of the vessel, thereby giving excellent control of the vessel. This is particularly important for so-called working vessels such as barge pushers on the lake. Since the vertical profile of the paddles 22 is the same on both sides, the efficiency of the system is the same regardless of the direction of rotation of the paddle wheel. Each power actuator system can be controlled or reversed independently of one another.

While a preferred embodiment has been described, it is to be understood that the invention is not limited thereto, but rather that it is intended to include all embodiments which would be apparent to one skilled in the art and which come within the spirit and scope of the invention.

I claim:

1. A paddle wheel vessel propulsion system comprising, an elongated paddle wheel, mounting means supporting the paddle wheel with its longitudinal axis in a horizontal plane, the paddle wheel including a plurality of elongated paddles mounted thereon at spaced intervals therearound for free rotation about axes parallel to and spaced from the longitudinal axis of the paddle wheel, first reversible power means operable to drive the paddle wheel for rotation about its longitudinal axis, said mounting means including second reversible power means operable to move the paddle wheel in a generally vertical direction, and third reversible power means operable to rotate the paddle wheel about a generally vertical axis perpendicular to its longitudinal axis, said first, second and third reversible power means being operable independently of one another.

2. The system defined in claim 1, wherein said third power means is operable to rotate said paddle wheel through an unlimited angle about said generally vertical axis.

3. The system defined in claim 2, wherein said first power means comprises reversible hydraulic motor means.

4. The system defined in claim 1, wherein said mounting means comprised a rigid platform supported by rollers for rotation about said generally vertical axis on an annular track mounted on the vessel.

5. The system defined in claim 2, wherein said mounting means comprised a rigid platform supported by rollers for rotation about said generally vertical axis on an annular track mounted on the vessel.

6. The system defined in claim 4, wherein said third power means includes at least one reversible hydraulic motor, and means driven by said at least one reversible hydraulic motor engaging said platform to drive the platform about said generally vertical axis.

7. The system defined in claim 5, wherein said third power means includes at least one reversible hydraulic motor, and means driven by said at least one reversible hydraulic motor engaging said platform to drive the platform about said generally vertical axis.

8. The system defined in claim 5, wherein said second power means comprises hydraulic rams carried by said platform.

9. The system defined in claim 1, wherein said elongated paddles each have opposed concave face surfaces and opposed convex top and bottom edges.

10. The system defined in claim 9, wherein said opposed faces surfaces are each defined by an elongated, generally arcuately curved metal plate, and wherein the metal plates are rigidly joined at the convex side edges of the paddle.

11. The system defined in claim 10, wherein the arcuately curved metal plates contact and are joined to one another along a line substantially equal distance from said convex side edges.

12. The system defined in claim 10, wherein said paddles are reinforced along their opposed convex edges by a metal bar, a metal pipe, or a section of a metal pipe.

13. The system defined in claim 11, wherein said paddles are reinforced along their opposed convex edges by a metal bar, a metal pipe, or a section of a metal pipe.

14. The system defined in claim 10, wherein said metal plates are spaced from one another adjacent their side edges to define a pair of open spaces therebetween extending from said convex edges to a position substantially midway between said convex edges, and wherein one only of said open spaces is filled with a heavy solid material.

15. A paddle for a paddle wheel of a vessel, the paddle comprising an elongated body defined by a pair of elongated metal face plates, a pair of end plates rigidly joining the ends of said face plates at each end of the paddle to support said face plates in opposed relation, shaft means rigidly joined to and projecting axially from each of said end plates for supporting the paddle for rotation about its longitudinal axis, said face plates being generally arcuate in transverse cross section and having their concave face directed outward to define concave surfaces of the paddle, and a substantially round bar, a pipe, or a section of a pipe extending between said end plates and defining the curvature of the top and bottom convex side edges of the paddle.

16. A paddle for a paddle wheel of a vessel, the paddle comprising an elongated body defined by a pair of elongated metal face plates, a pair of end plates rigidly joining the ends of said face plates at each end of the paddle to support said face plates in opposed relation, shaft means rigidly joined to and projecting axially from each of said end plates for supporting the paddle for rotation about its longitudinal axis, said face plates being generally arcuate in transverse cross section and having their concave face surfaces directed outwardly to define opposed concave face surfaces of the paddle and having their adjacent parallel side edges reversely bent and joined by welding to define convex top and bottom edges of the paddle.

17. The paddle defined in claim 16, wherein the convex inner surfaces of the opposed face plates contact each other and are rigidly joined substantially along the longitudinal axis of the paddle.

18. The paddle defined in claim 17, wherein the means joining adjacent parallel edges of the opposed face plates comprises a substantially round bar, a pipe, or a section of a pipe extending between said end plates and defining the curvature of said convex side edges.

* * * * *